United States Patent [19]

Weldon

[11] Patent Number: 4,722,402

[45] Date of Patent: Feb. 2, 1988

[54] ELECTROMAGNETIC DRILLING APPARATUS AND METHOD

[76] Inventor: James M. Weldon, P.O. Box 26092, Austin, Tex. 78755

[21] Appl. No.: 822,773

[22] Filed: Jan. 24, 1986

[51] Int. Cl.[4] ..... E21B 4/12

[52] U.S. Cl. ..... 175/104; 175/73; 175/293; 175/419

[58] Field of Search ..... 175/27, 51, 56, 61, 175/73, 104, 105, 293, 320, 417, 419, 420; 340/856, 857, 861; 367/83, 84, 85; 174/47, 9 F; 339/94 C, 94 M, 16 C, 16 R

[56] References Cited

U.S. PATENT DOCUMENTS

| | | | |
|---|---|---|---|
| 2,740,095 | 3/1956 | Somes | 174/47 X |
| 2,795,397 | 6/1957 | Hull et al. | 174/47 |
| 2,858,108 | 10/1958 | Wise et al. | 175/56 |
| 2,868,507 | 1/1959 | Scott et al. | 175/105 X |
| 3,043,381 | 7/1962 | McNeely, Jr. | 175/73 |
| 3,163,244 | 12/1964 | Zimmerman | 175/418 X |
| 3,421,591 | 1/1969 | Webb | 175/417 X |
| 3,637,032 | 1/1972 | Jeter | 175/73 |
| 3,760,894 | 9/1973 | Pitfer | 175/419 X |
| 3,866,678 | 2/1975 | Jeter | 175/104 X |
| 4,012,092 | 3/1977 | Godbey | 339/16 R |
| 4,445,734 | 5/1984 | Cunninghan | 339/16 C |
| 4,584,675 | 4/1986 | Peppers | 340/856 X |

*Primary Examiner*—Stephen J. Novosad
*Assistant Examiner*—David J. Bagnell
*Attorney, Agent, or Firm*—Marcus L. Bates

[57] ABSTRACT

Oil well drilling apparatus for drilling deep boreholes. The apparatus includes a high frequency, high voltage, AC generator at the surface of the ground which is connected to an electromagnetic hammer drill bit located at the bottom of the borehole. Electric current is conducted along a special drill string to the electromagnetic hammer drill located at the bottom of the hole. The drill string is a co-axial electrically conductive drill pipe which forms spaced annular current flow paths to the downhole electromagnetic hammer drill, while at the same time, drilling fluid flows along an axial flow path to the vibrating bit located at the bottom of the borehole. A special directional drill collar is positioned immediately above the electromagnetic hammer drill for controlling hole deviation. The co-axial electrically conductive lightweight drill pipe, the electrically conducting control deviation drill collars, and the electromagnetic hammer drill bit and pulse transformer each form a subcombination of the present invention; and, jointly comprise a new method and apparatus for forming boreholes.

19 Claims, 13 Drawing Figures

ELECTROMAGNETIC DRILLING APPARATUS AND METHOD

BACKGROUND OF THE INVENTION

The drilling of boreholes deep into the bosom of the earth require special equipment and technology. The conventional rotary drill bit, when extended 30,000 feet into the earth, requires careful consideration of the drill string because ordinary drill pipe can hardly support itself beyond this tremendous depth. Moreover, the massive drawworks required for rotating and manipulating a 30,000 footh conventional tool string is awesome to those not highly skilled in the art.

The drilling of extremely deep boreholes require that particular attention be paid to the hydrostatic head effected within the annulus for the reason that exceptionally high pressures can be encountered as the borehole is sunk through unknown geological formations.

In sinking extremely deep boreholes, it is therefore desirable to have made available a very light weight, durable drill string. On the other hand, it is necessary that the borehole forming tool string have adequate weight effected on the bit thereof so that the bit can be made to properly engage the borehole bottom with sufficient force to efficiently remove cuttings therefrom. Therefore, it is advantageously that a tool string for deep holes have as much weight as possible consigned to the area near the drill bit motor, while at the same time the structural integrity of the drill string enables proper and safe manipulation of the entire tool string.

Reciprocatory drill bits have many advantages over a rotary type bit, and vice versa. The reciprocatory or vibrating bit is still held in high esteem by some drillers for penetrating very hard formations. There are many advantages realized with a reciprocatory drill bit when making a deep hole, especially when the bit motor is located downhole adjacent the bit. Examples of reciprocatory bits and motors are set forth in U.S. Pat. Nos. 2,949,850 to Heath; 2,340,738 to Dilly; and 1,062,050 to Stewart.

There are many problems to be overcome in order to conduct a source of power from the surface of the earth down to a motor device located downhole adjacent to the bit and solutions thereto are the subject of several patented inventions, as for example: U.S. Pat. Nos. Godbey 4,012,092; Hull et al 2,795,367; Garret 4,436,118; and Cunningham 4,445,734.

In drilling deep holes, it is desirable to maintain the hole deviation to a minimum by the provision of an apparatus which senses the direction of hole deviation and changes the direction of penetration of the bit to manitain the hole axis aligned along a vertical axis. Jeter U.S. Pat. No. Re. 29,526 is an example of the prior art. Other prior art patents related to the present combination are:

| | | | | | |
|---|---|---|---|---|---|
| U.S. | 2,858,180 | issued | Wise | on | October 20, 1958 |
| Pat. | 2,868,507 | to | Scott | | January 15, 1959 |
| No. | 3,043,381 | | McNeely Jr. | | July 10, 1962 |
| | 3,811,519 | | Driver | | May 21, 1974 |
| | 3,903,974 | | Cullen | | September 9, 1975 |
| | 3,139,146 | | Bodine | | June 30, 1964 |
| | 4,354,561 | | Logan | | October 19, 1982 |

The present invention sets forth a new combination of elements assembled in a manner to provide a novel drill string apparatus by which a deep hole can be achieved.

There are numerous other patents directed to concentric drill pipe wherein drilling fluid flows to and from the bit along isolated annular flow paths. These patents relate to the "concore" method of drilling and are considered of interest, but do not comprehend nor solve all of the problems involved herein.

SUMMARY OF THE INVENTION

This invention relates to improvements in apparatus for drilling deep boreholes, especially boreholes beyond 25,000 feet in depth. The invention comprises a new combination of elements assembled into an unusual tool string that provides a new method of drilling boreholes.

The tool string of the present invention comprises improvements in the following:

(1) fluid and electrical conducting pipe joints, a plurality of which can be series connected to provide a new pipe string;

(2) directional drill collar for controlling borehole deviation which also conducts fluid and electricity;

(3) downhole motor means for vibrating a bit, which can be attached to the directional drill collar. The motor means preferably is a coaxial pulse transformer; and, (4) electromagnetic hammer drilling bit connected to the pulse transformer.

The fluid and electrical conducting pipe joints of this invention comprise inner and outer cylindrical conductive members concentrically arranged along a common axis with there being an annular space therebetween which is filled with insulation and high strength fibers, and thereby insulates the two conductive members from one another while firmly bonding the two conductive members together.

Fastener means are provided at opposed ends of the joint by which a plurality of the pipe joints may be connected together into a pipe string of very long length. The fastener means provide a fluid tight joint while at the same time provides a contact area by which electrical current can be conducted from one to another pipe joint.

The directional drill collar has fastener means at opposed ends thereof which are similar to the drill pipe joints, and which enables one or several of the collars to be series connected, while at the same time fluid and electrical current is conveyed from the lower end of the drill string to the motor means. The collar includes inner and outer concentric cylindrical conductors which are insulated from one another and bonded together to form an annular bowing chamber between the outer and inner members. The bowing chamber includes a plurality of circumferentially spaced parallel passageways which are parallel to the longitudinal axis of the collar. A pressure differential is effected on opposed chambers to bow the collar and cause the hole deviation to change.

The downhole electromagnetic hammer drilling bit includes the combination of an electric motor and a vibrating bit. The electric motor is attached to the lower end of the directional collar, while the bit is attached to the motor. The motor includes a primary and secondary coil arranged with the primary being energized by current flowing through the drill string. The motor further includes an eddy current plate which vibrates in response to the current characteristics. The eddy current plate is connected to move the cutting face of the bit against the formation being penetrated.

The hammer drill bit of the present invention has an upper cylindrical body part rotatably attached to the motor means, and cutter blades connected to be vibrated by the eddy current plate. The bit body is provided with vertical slots and the cutter blades reciprocate or vibrate within the slots. The blades are attached to a central member which is vibrated by the eddy current plate.

Accordingly, a primary object of the present invention is the provision of an improved drill or tool string for forming a borehole, having an electrically actuated motor and bit at the lower end thereof, with the drill string being arranged to convey drilling fluid and electrical current downhole to the motor means.

Another object is to provide a new combination comprising a drill pipe string, a directional drill collar, an electrically actuated motor means, and a bit; whereby drilling fluid can be conveyed axially down the string to the bit, while electrical current is conducted through isolated parts of the string to the motor means.

A further object is to disclose and provide a drill pipe string having joints of drill pipe which conduct fluid and electrical current therethrough, with each joint of pipe having a sub at either end thereof by which the joint can be made up into a string of drill pipe.

A still further object of this invention is to provide a drill pipe made of concentric annular members which form a current flow path therethrough, with there being an axial passageway formed along the longitudinal axis of the members.

Another and still further object is to provide a directional drill collar for connection in a drill string that orients a drill bit respective to the vertical axis, which has an axial passageway formed therethrough for the flow of drilling fluid to a bit located at the lower end thereof, with there being concentric annular electrical conductors through which current can flow to a motor connected below the stabilizer for actuating said bit.

An additional object is to provide a tool string comprising a multiplicity of pipe joints connected together and to a directional drill collar, with each said joint being made of concentric inner and outer annular members insulated from one another so that electrical current can flow down one annular member and back up through the other annular member, with there being an axial fluid flow passageway formed through said string whereby a drill bit and electric motor can be connected to the bottom of the string for drilling boreholes.

An additional object is the provision of a combination drill motor and bit comprising a pulse transformer having induction coils arranged to reciprocate and Eddy current plate, with a part of the bit being mounted to the plate to cause said part of the bit to vibrate in response to movement of said Eddy current plate.

An additional and still further object is the provision of a drill bit having a main body attached to a vibratory motor means, and a plurality of bit blades mounted on the bit, wherein the blades are mounted for reciprocation respective to the bit body, with there being means connected to the blades to cause the motor means to vibrate the bit blades.

An additional object is to provide an improved drill bit having a main housing affixed to the lower end of a motor housing, with there being slots formed within the lower end of said bit housing and dividing the lower end of the housing into legs, and a blade reciprocatingly received within each of the slots of the bit housing and connected to be moved by the motor means.

Another and still further object it to provide a bit having a main body, a plurality of blades reciprocatingly received within said main body and dividing said main body into segments, with there being means for reciprocating the blades, and with the blade members being made assymmetric so as to induce a turning moment into the bottom of the bit with each reciprocation of the blade members.

An additional object is to provide a tool joint having a fastener at the end by which it can be attached to another tool joint, with there being provisions by which an electrical current flow path is formed through said tool joint and at the same time an axial fluid flow path is formed through the tool joint.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENT

Figure 1:
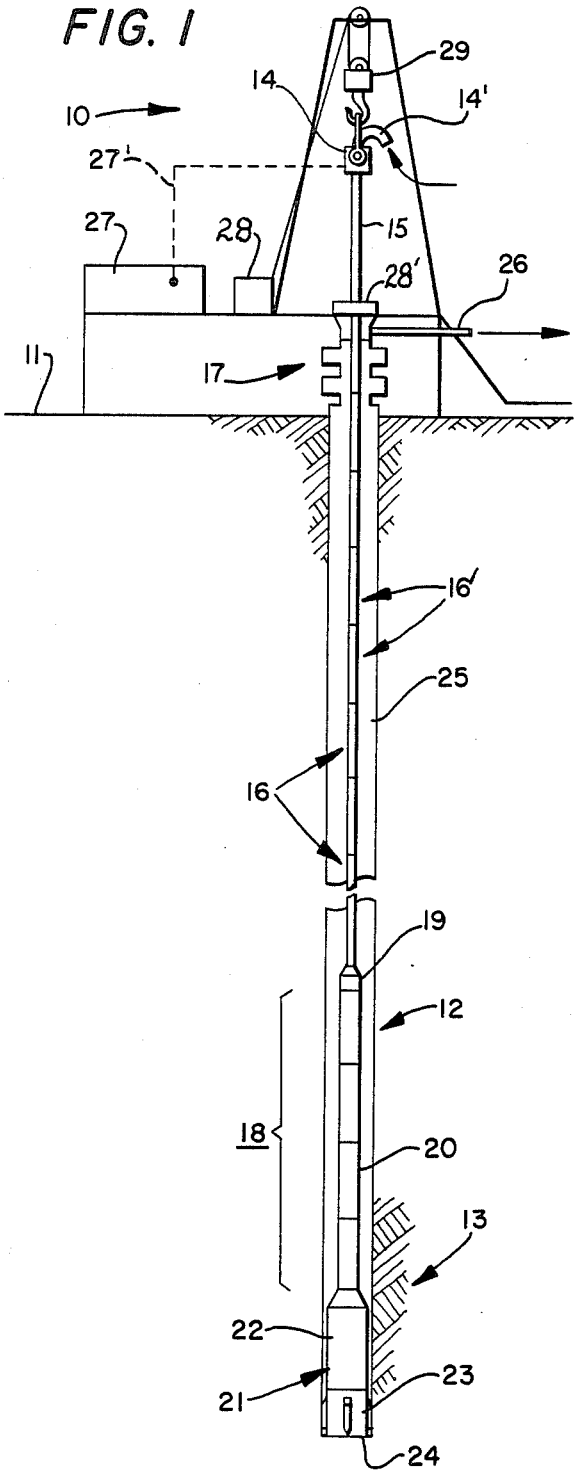
FIG. 1 is a part diagrammatical, part schematical, part cross-sectional view of a section of the earth having a drilling operation associated therewith made in accordance with the present invention.

In FIG. 1, there is disclosed a drilling rig 10 having a number of prior art apparatus arranged in the illustrated manner of the drawings so as to better enable the present invention to be practiced. The drilling rig 10 is supported above the surface 11 of the ground and forms a borehole 12 which extends downhole through various different geological strata or formations 13.

The drilling rig includes a swivel apparatus 14 of the prior art, having a drilling fluid inlet 14' connected to prior art mud pumps (not shown) and thereby provides a flow of drilling fluid or mud through connector pipe 15.

A drill string 16 extends downhole within borehole 12 and includes a connector pipe 15. The drill string extends through a blowout preventor unit 17. The usual pipe support bushing and slips are located above the blowout preventor unit 17 for supporting the drill string from the rig 10.

The drill string includes a multiplicity of series connected drill pipe joints 16' which extend downhole to a drill collar assembly 18. The drill collar assembly 18 includes a drill collar deviation control unit 19 and a plurality of drill collars 20. The drill collar assembly 18, drill pipes 16', and connector pipe 15 are designed in a manner whereby current flows from the swivel 14 down to a combination electromagnetic hammer drill bit and pulse transformer 21. The hammer drill and pulse transformer combination 21 includes a pulse transformer 22 and bit 23. The lower face of the bit 23 engages the bottom 24 of the borehole 12.

Borehole annulus 25 extends back up through the blowout preventor unit 17 and to an outlet 26. A compulsator or high voltage alternator 27 provides a pulse power supply of current which is connected at 27' to the swivel 14, thereby providing a source of current to the downhole pulse transformer 22.

In the operation of FIG. 1, drilling fluid, which can be water, air, or drilling mud, is forced by the mud pumps (not shown) to inlet 14' of the swivel 14 where the drilling fluid flows down connector pipe 15, through the drill pipes 16, through the interior of the drill collar assembly 18, through the pulse transformer 22, and out of the bit 23 where the cuttings formed by the lower face of the bit 23 are forced to flow back up through the borehole annulus 25, through the blowout preventor unit 17, where the cuttings and drilling mud exit at outlet 26 and is usually conducted to a mud pit (not shown).

The power output from compulsator or alternating current generator 27 is electrically connected to the swivel 14 which contains slip rings for transferring current which flows down through connector pipe 15, drill pipes 16, drill collar assembly 18, and to the pulse transformer 22. The pulse transformer vibrates or reciprocates the bit 23 at a particular frequency and thereby makes hole, that is, removes cuttings from the geological formation 13 that forms the bottom 24 of the hole so that the borehole continues down through the earth's structure.

A return current flow path is formed from the pulse transformer 22, back up through the drill collar assembly 18, up through the drill pipes 16, through the connector pipe 15, into the swivel 14, and back to the compulsator or electrical generator 27, thereby completing the circuitry.

A drawworks 28 is connected to vertically move the traveling block 29 which in turn moves the swivel 14 so that the entire drill string can be held supported from the derrick and a predetermined weight applied to the bit for reasons appreciated by those skilled in the art.

Figure 2:
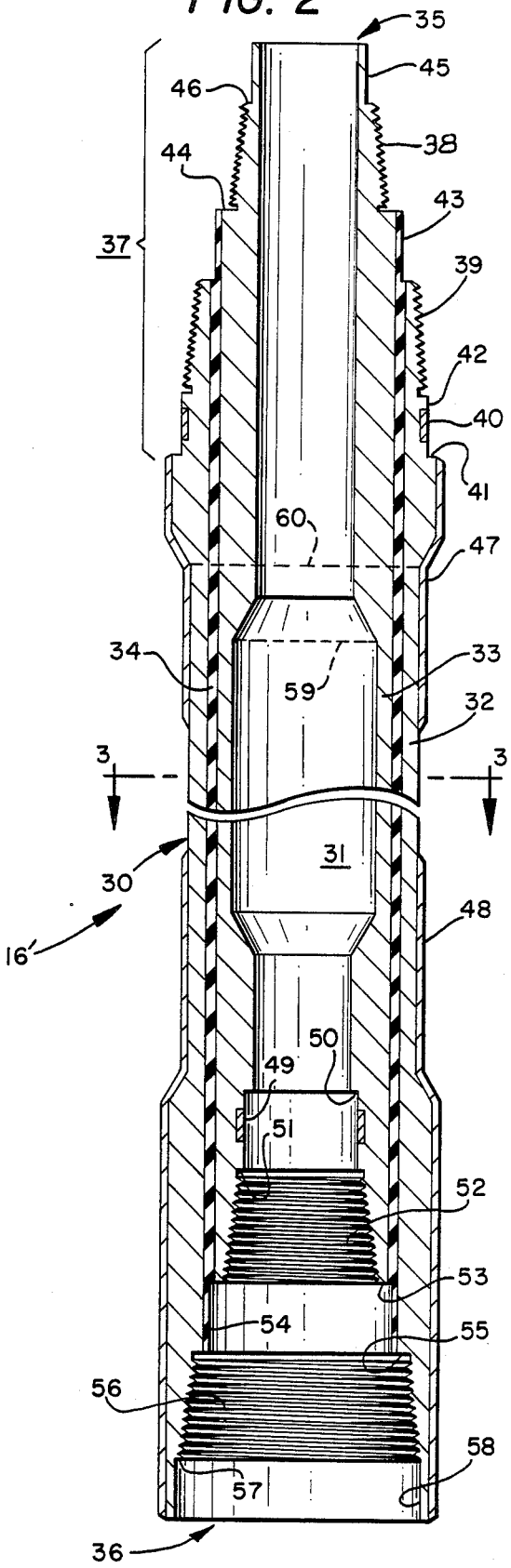
FIG. 2 is an enlarged, longitudinal, cross-sectional view of part of the apparatus disclosed in FIG. 1.
Figure 3:
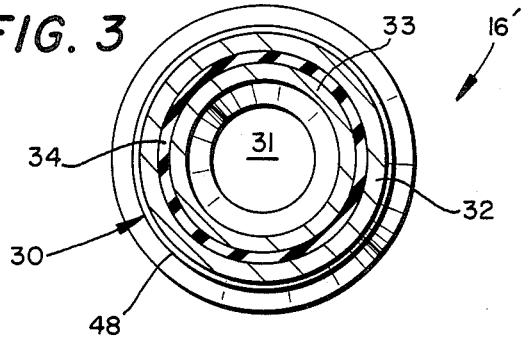
FIG. 3 is a cross-sectional view taken along line 3—3 of FIG. 2.
Figure 4:
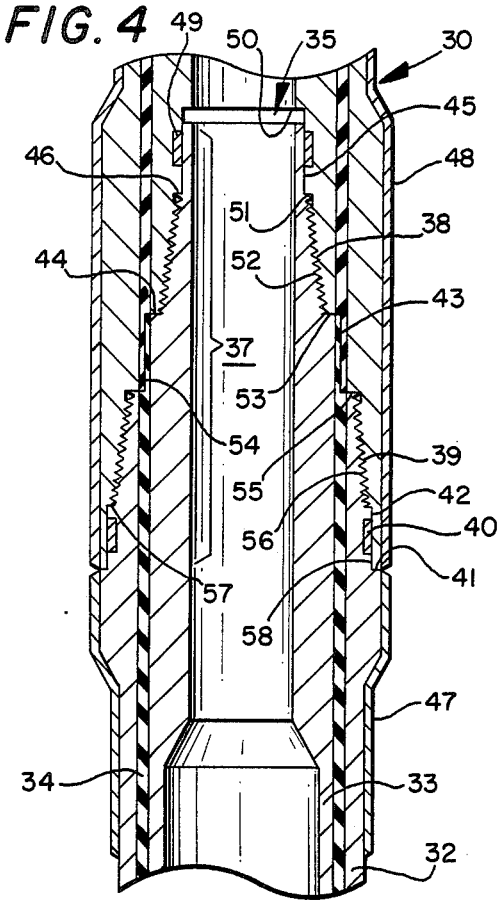
FIG. 4 is a broken, longitudinal, cross-sectional view of part of the apparatus disclosed in FIG. 1.

In FIGS. 2–4, there is disclosed the details of the before mentioned joints of drill pipe 16. The drill pipe 16, as seen in FIGS. 1 and 4, is made of a multiplicity of pipe joints connected together in series relationship. Each joint of the string has an outer surface 30 and an interior axial passageway 31. The pipe joints are made of concentric insulated metal pipe with there being an outer metal conductor pipe 32 and an inner metal conductor pipe 33. Electrical insulation material 34 is placed between the conductor pipes 32 and 33 so that a current flow path is formed down the outer annular member 32 and a return current flow path is provided up through the inner annular member 33, or vice versa. The outer annular member 32 and inner annular member 33 preferably are made of aluminum alloy with there being insulation 34 of epoxy together witn non-conductive fibers of glass or boron or the like therebetween.

The insulation 34 used between the concentric conductors of the drill pipe and collar is an epoxy compound together with non-conductive fibers of glass or boron. The inner conductor is coated with epoxy compound and the fibers are wound at cross angles thereon to provide a biased construction of great strength. The biased angle is selected to provide the optimum transfer of load between the inner and outer conducting members.

A high density polymer, such as Tuffram TM is used to provide a coating on the entire inside and outside wall surface of the tool string, especially near the lower end thereof in proximity of the motor and bit. This and other suitable material can be used to provide insulation on both the inner and outer surface to prevent electrical current flow between the inner and outer conductor pipes 32 and 33 via the drilling mud, as well as preventing reaction between the mud and the tool string.

Each joint of conductor drill pipe 16 terminates at the upper or pin end 35 and at the lower or box end 36. The pin end 35 is a male fluid and electrical conducting member while the lower end 36 is a female fluid and electrical conducting member. The upper or pin end 35 is provided with a dual stage threaded connection 38 and 39. The aluminum threads preferably are coated with a suitable low friction coating such as Tuffram TM to prevent excessive thread torque or thread welding. A resilient electrical contactor, such as, for example, A Multilam TM 40 is placed within the illustrated groove formed between spaced shoulders 41 and 42. An insulated annular area 43 separates threads 38 and 39 from one another. An annular conducting area 45, located at the upper marginal end of the pin end of pipe 16, provides an electrical connection by which a current flow path for the inner annular member 33 can be established. Numeral 47 indicates hard metal that is added to the outer surface area of the connection at the pin end 35.

The box end 36 of the drill joint pipe 16 has likewise been provided with hard metal 48, such as steel or steel alloy, about the outer peripheral wall surface thereof. The female or box end 36 of the pipe joint 16 includes a Multilam connector 49 on the interior thereof which makes an efficient electrical contact respective to the annular area 45 of the pin end of the next adjacent pipe joint, as best seen illustrated in the connection effected by the two pipe joints of FIG. 4. As seen in FIG. 2, an internal shoulder 50 abuttingly receives the terminal end 35 of the adjacent pipe joint. Shoulder 51 separates the annular area 49 from threaded area 52. Shoulder 53 separates the annular area 54 from threaded area 54. Shoulder 57 separates annular area 58 from threaded area 56. The annular area 58 makes efficient electrical contact with Multilam 40 of an adjacent joint of pipe.

The insulation at 43 and 54 is configured to minimize tracking across the insulation. The male insulated part at 43 on one joint is fitted snugly into the female insulated part 54 of an adjacent joint, as illustrated in FIG. 4, and thereby provides coacting insulated fittings that seal the mud from intrusion therebetween.

The cooperative relationship between adjacent joints of pipe, and the manner in which both fluid and electric current are conducted downhole to the bit and bit motor, are more fully set forth in the longitudinal, cross-sectional, representation of FIG. 4.

The concentric pipes 32 and 33 preferably are made of 6061 T6 aluminum alloy, and the insulation 34 preferably is epoxy resin having thermal expansion characteristics closely matched to the thermal expansion characteristics of the metal 32 and 33 as possible.

In operation, drilling fluid is conducted downhole to the bit along the longitudinal passageway 31 while current is conducted through each of the joints of pipe. As seen in FIG. 4, current flow towards the pulse transformer 21 is achieved through the outer metal conductor pipe 32, through shoulder 58 at the box end, through the Multilam 40 located at the pin end of the next adjacent pipe joint, and through the outer metal conductor of the next pipe joint. Return current flow is connected through the inner metal conductor pipe 33, through the annular area 45 at the pin end of the pipe, into the Multilam 49 located at the box end of the next joint of pipe, and into the inner metal conductor pipe of the next pipe joint.

The weight of each joint of pipe 16' that makes up the fluid and electrical conducting drill string 16 can advantageously be held to a fraction of the weight of a standard rotary drill pipe joint especially when the drill string 16 of this invention is not subjected to torque. The drill pipe 16' does, of course, need to be of the required strength to lift the entire drill string. This makes it theoretically possible to fabricate a four inch drill string 16 of approximately nine pounds per foot, that is, a standard 30 foot joint 16' of the drill string 16, including the box and pin ends, can be made to weigh as little as three hundred pounds. The tensile strength of a typical four inch joint of drill string 16 having a ½ inch wall is 400,000 pounds; and, the wall thickness can be increased to one inch to further increase the tensile strength. Accordingly, it is believed possible to build the drill string of the present invention to sustain a load at the derrick representative of 40,000 feet of tool string, which includes a stabilizer of considerable weight and a drill bit and motor weighing, for example, 2500 pounds. This string is approximately one-half the weight of a steel pipe string in air, and in mud the string would have still less effective weight due to its bouyancy.

Each of the joints 16' of the drill string 16 are provided with hard metal 47 at the pin end and hard metal 48 at the box end. This reinforcement is the area where the joints are held by the slips, and where the adjacent joint is engaged by the power tongs, otherwise specially designed power tongs and slips would have to be incorporated into the drilling system to avoid damage to the box and pin ends as the joints are made up and broken out while going into and out of the borehole.

The hard metal overlay at 47 and 48 is a selected steel alloy which is placed by rolling a sleeve down to shrink fit the sleeve against the aluminum. Where stainless steel is employed as the sleeve, it is work hardened during the shrinking process. The sleeve can also be applied by a swedge ring and hydraulic press to swedge the sleeve onto the pipe.

As a specific example of the preferred embodiment of this invention, a four inch drill pipe is to be fabricated with the inner metal conductor pipe 33 being made from 3/16 inch thick aluminum alloy identified as 6061 T6 alloy. The outer metal conductor pipe 32 will be made of the same aluminum alloy. The epoxy resin insulation 34 is ⅛ inch thick. The wall thickness of the completed pipe joint is ½ inch thick. The wall thickness of the inner and outer members can be increased to ⅜ inch thickness to provide a stronger pipe, as may be required for a rotary tool string, for example, in order to transfer torque safely.

The concentric inner and outer metal conductor pipes 32 and 33 can be fabricated in a number of manners, such as, for example, as follows: the small and large components 38 and 39 of the threaded end of the pin end are welded into position at weld lines 59 and 60. Thereafter, epoxy resin 34 will be applied to both the outer surface of member 33 and the inner surface of member 32. The two members will then be telescoped together utilizing suitable hydraulic rams; and, the excess epoxy will be forced from the opposed marginal ends of the completed conductor pipe 30. The hard surfacing sleeves at 47 and 48 can be applied to the opposed subs of the box and pin ends prior to or following the assembly.

It is necessary that the pin end 61 of the drill collar assembly 18 have the capability of threadedly mating with the box end 36 of the lowermost end 35 of the drill pipe, otherwise an adaptor sub can be fabricated for adapting the drill pipe to the collar. The adaptor sub can be fabricated by constructing the upper marginal end thereof in a complementary manner respective to the lower marginal end of the pipe joint 16'; and, the lower marginal end thereof in a complementary manner respective to the upper marginal end of the collar 18.

Figure 5:
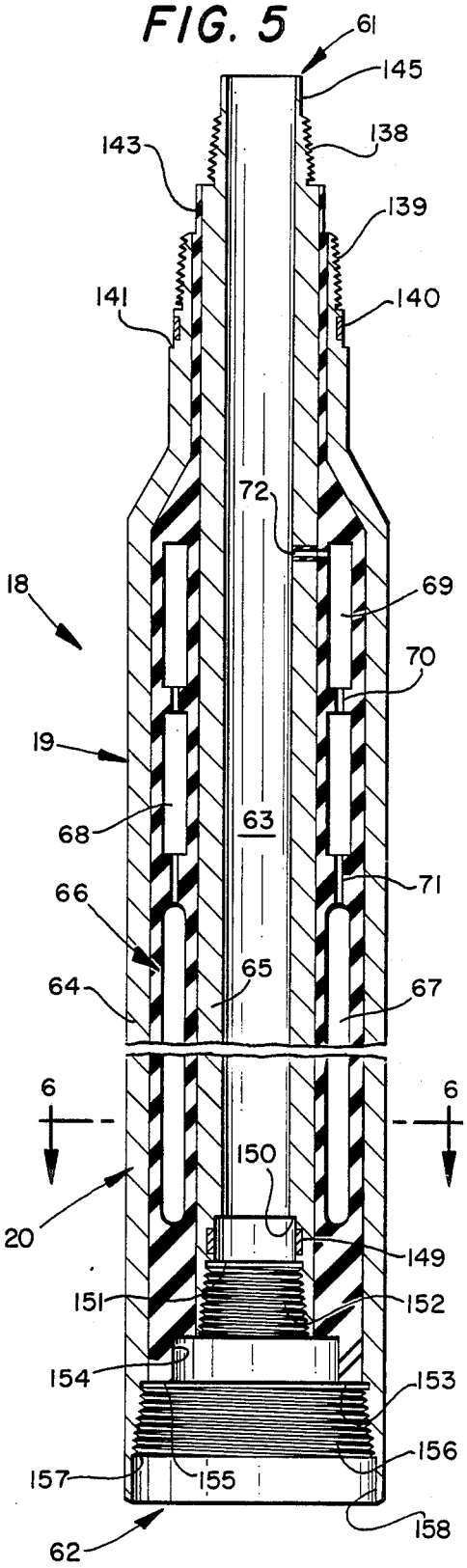
FIG. 5 is an enlarged, longitudinal, cross-sectional view of part of the apparatus disclosed in FIG. 1.

The details of the electrical conducting and fluid conducting control deviation drill collar assembly seen at 18 in FIG. 1 is set forth in FIGS. 5–8. As seen in FIG. 5, together with FIGS. 1 and 6–8, the drill collar system of the present invention comprises a main annular housing which terminates at opposed pin and box ends, 61 and 62. The pin and box ends preferably are made in the same manner of the drill pipe as set forth in FIGS. 2–4. An axial passageway 63 extends through the drill collar 18 and conducts drilling fluid from the drill pipe, through the collar, and to the electromagnetic hammer drill bit 21.

The drill collar system 18 of this invention preferably comprises one very long drill collar, as set forth in FIG. 5, or a plurality of series connected collars, as set forth in FIG. 1. The length of each collar and the number incorporated into the string is as may be deemed desirable, depending upon the degree of curvature it is contemplated to impart into a particular borehole as the formation is being penetrated by the bit 23.

The drill collar 18 includes an outer annular electrical conductor 64, usually made of steel alloy in order to develop the desired bit weight, although the collar can be made of aluminum or other electrical conducting material should it be desired to maintain the collar weight at a minimum value. An inner annular electrical conductor 65, fabricated from steel, aluminum, or aluminum alloy, is spaced from the outer conductor 64 by an insulated annular working chamber 66. The insulated working chamber 66 preferably is made of epoxy resin or other similar type of plastic or plastic-like insulation material.

Figure 6:
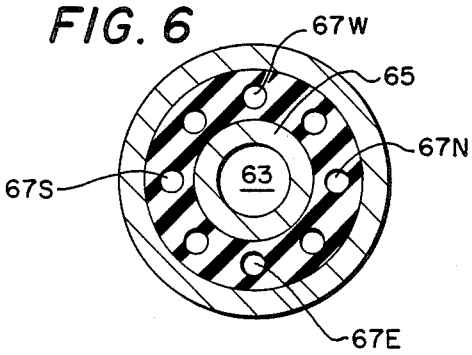
FIG. 6 is a cross-sectional view taken along line 6—6 of FIG. 5.
Figure 7:
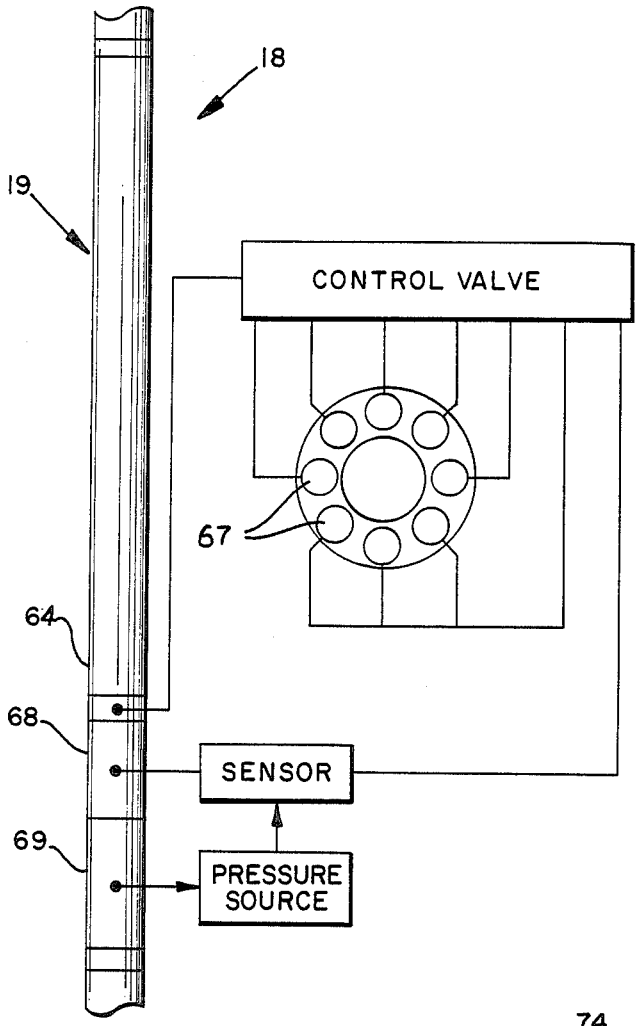
FIG. 7 is a broken, enlarged, side elevational view of part of the apparatus disclosed in FIG. 1, together with a schematical representation of control apparatus therefor.

A plurality of high pressure bowing cavities 67 are arranged within the plastic member that forms the annular chamber 66, and the cavities are circumferentially spaced apart from one another in the illustrated manner of FIG. 6, for example. In FIGS. 6 and 7, the elongated, spaced bowing chambers 67 are located adjacent to a directional sensing, surface actuated, pressure control device 68, which in turn is located adjacent to a mud-to-oil pressure intensifier 69.

The mud-to-oil pressure intensifier 69 is connected to the directional sensing pressure control 68 by means of a control fluid passageway 70. The directional sensing pressure control 68 is connected to the bowing chambers 67 by a series of passageways 71, there being one control passageway 71 for each bowing chamber 67, in the illustrated manner of FIGS. 6 and 7, for example.

The intensifier 69 senses the drilling fluid pressure within the axial passageway 63 by means of an inlet port 72. Means are provided within the intensifier 69 by which the pressure received at inlet port 72 is elevated. This expedient is known to those skilled in the art and can be carried out, by way of example, by the provision of pistons having opposed faces of different areas.

The elevated pressure achieved at 69 is effected upon selected ones of the bowing cavities 67 by the selective action of a valve means at 68. The valve 68 is connected to open or close selected ones of passageways 71, as schematically illustrated in FIG. 7, for example.

The control valve means that controls fluid pressures leading to any selected ones of the bowing passageways can be actuated from the surface by sending a signal related to data from the sensor uphole along the conductive drill pipe, while a control signal is returned downhole along the same electrical conductors. Moreover, by sending data uphole, the drilling operation can be closely monitored.

In FIG. 7, the drilling fluid pressure has been elevated at 69 to provide the illustrated elevated pressure source. The sensor at 68 senses the direction and magnitude of the hole deviation and opens the appropriate valve associated with the appropriate one of the passageways 67, thereby effecting pressure within selected ones of the bowing chambers 67, and turns the hole away from or towards the vertical, as may be desired. An outlet valve can be positioned for exhausting selected ones of the chambers 69 directly to the borehole annulus thereby reducing the pressure therein. This enables opposed blowing chambers to be connected to the tubing pressure and annular pressure, which represents a considerable pressure differential and enhances the bowing action of the colar.

Figure 8:
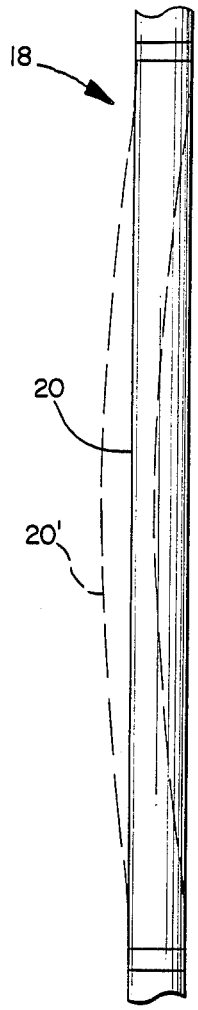
FIG. 8 is a side elevational view of the apparatus seen in FIGS. 5–7.
Figure 9:
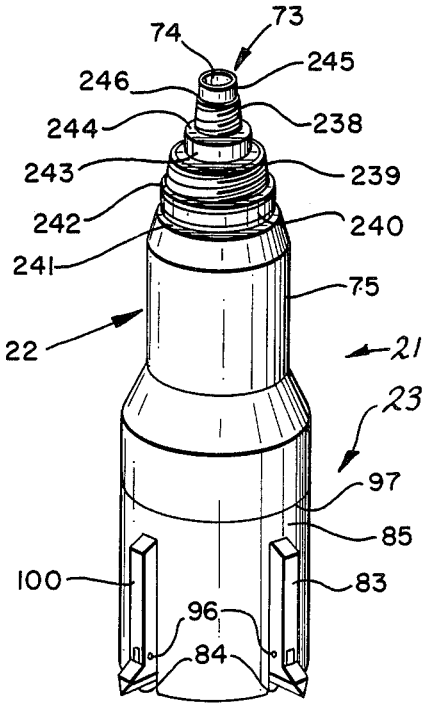
FIG. 9 is an enlarged, perspective side view of part of the apparatus disclosed in FIG. 1.

Fore example, assuming that the bowing cavities 67 are oriented in the manner of FIG. 6, and it has been determined that the hole deviation is slanting the borehole to the north, pressure can be effected upon bowing chamber **67*n*, thereby bowing the collar in the manner indicated by numeral 20' in FIG. 8**, so that the drill bit is forced to turn south, whereupon, the deviated hole is brought back into proper vertical alignment.

An example of a sensor 68 is set forth in U.S. Pat. No. 3,637,032 to Jeter.

Accordingly, by effecting the pressure at 69 on appropriate ones of the bowing cavities 67 in accordance with the signal received from the sensor 68, and opening the appropriate valve leading to the selected bowing cavities, the borehole can be maintained in vertically disposed relationship.

FIGS. 9–13 set forth the details of the preferred embodiment of the combination 21, which comprises an electromagnetic hammer drill bit 23, and a pulse transformer 22, broadly seen illustrated in FIG. 1. As particularly seen in FIG. 10, together with other figures of the drawings, the electromagnetic motor or pulse transformer 22 is shown rotatably attached to the hammer drill bit 23 of the present invention. The bit and motor combination 21, comprised of members 22 and 23, include an upper pin end 73 made complementary respective to the box end of the drill collar deviation control unit so that both drilling fluid and electrical current can flow down the drill string and to the motor means 22 of the hammer drill bit assembly 21. It is essential that the drilling fluid pass through the pulse transformer 22, and this is achieved by the provision of the illustrated axial passageway 74 which enables the flow to continue on to the hammer drill bit 23. The motor apparatus 22 includes a current conducting, annular, outer motor housing 75, and an annular fluid and current conducting inner motor housing 76. The housings 75 and 76 are spaced from one another to provide an annular insulated member within which the components of a coaxial pulse transformer 78 is housed.

Figure 10:
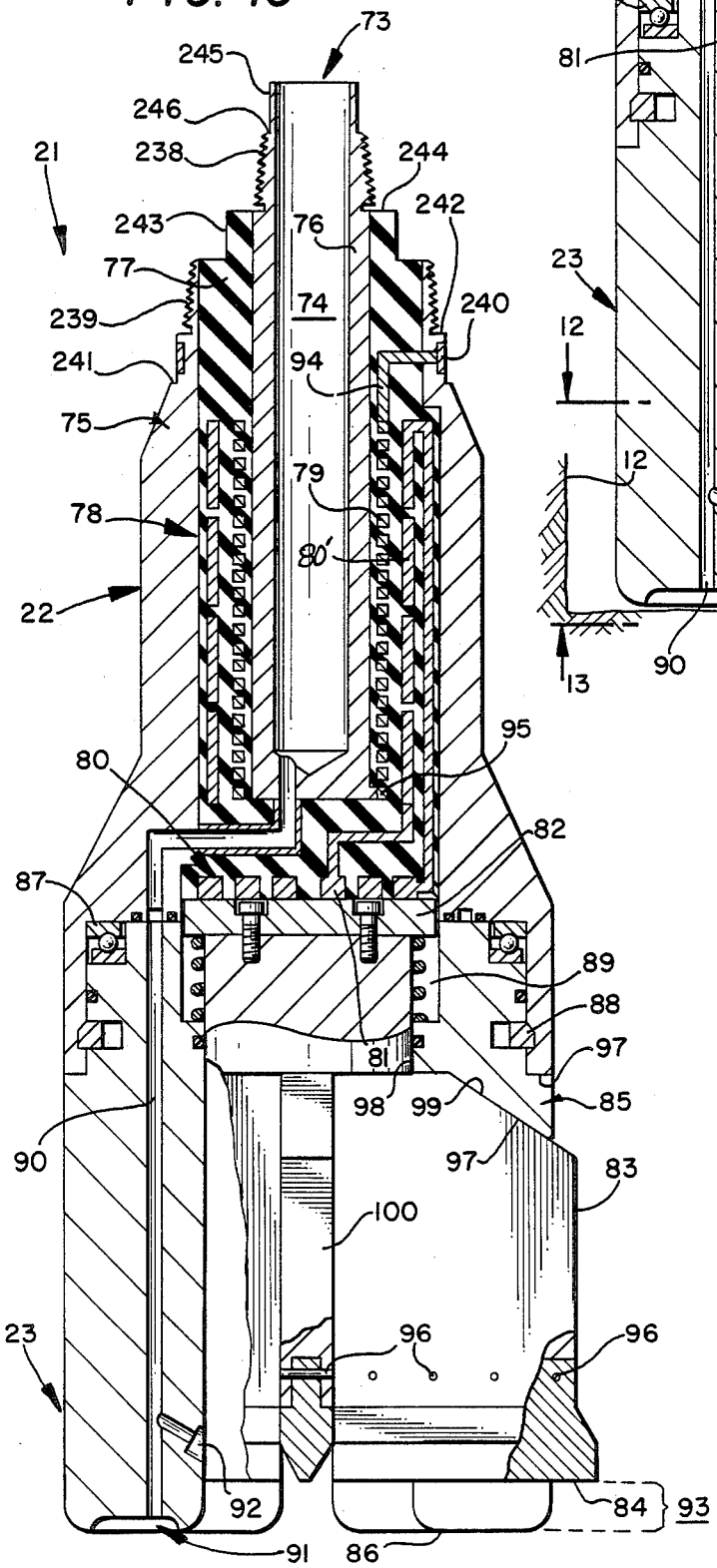
FIG. 10 is an enlarged, part cross-sectional view of the apparatus disclosed in FIGS. 1 and 9.
Figure 11:
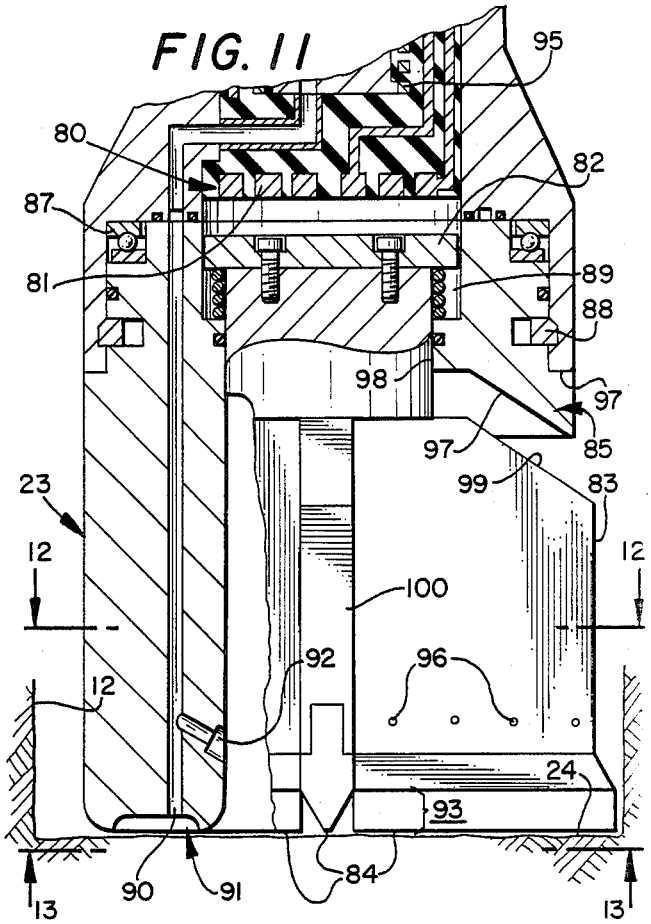
FIG. 11 is a broken, part cross-sectional view showing the apparatus of FIG. 10 in an alternate configuration.

The pulse transformer 78 has an electrical primary 79 and a secondary 80'. The secondary 80' is connected to a repulsion hammer coil 80 arranged in a horizontal plane and in parallel relationship respective to the illustrated high conductivity Eddy current plate member 82. The member 82, as seen in FIGS. 10 and 11, is captured in a manner to allow limited movement along the vertical axis and rotational axial movement of the entire bit. The plate member 82 therefore can vibrate a magnitude consistent with the movement of a plurality of bit blades 83.

The primary and secondary coils 79 and 80' are fixed respective to the outer and inner motor housings 75, 76, while the Eddy current plate 82 is affixed to the blades 83 of the hammer bit 23. The lower end 84 of the blades 83 is provided with hard surfacing material, such as tungsten carbide, polycrystalline diamonds, or any other similar material which can impart the desired boring characteristics into the cutter blades 83.

The bit 23 further includes a rotatable main body portion 85 which extends downwardly to the lower terminal end 86 of the bit and forms a hydrostatic bit support 91 at the lower terminal end thereof, the details of which will be more fully described later on.

The rotatable main body 85 is journaled to the outer motor housing 75 by means of the illustrated large bearing means 87. A keeper 88 rotatably locks members 85 and 75 together in a captured manner. The spring chamber 89 is formed between members 83 and 85. The illustrated compression spring is housed within chamber 89 and biases the upper face of the Eddy current plate 82 in an upward direction and into abutting engagement with the lower face of the repulsion hammer coil 80. The extreme opposite positions of operation of members 83 and 85 are seen in FIGS. 10 and 11. Movement in one direction causes the spring to assume a completely collapsed configuration in the illustrated manner of FIG. 11. The characteristics of the spring are selected consistent with the vibratory characteristics of the plate member 82.

The operation of the bit and motor combination 21 is as follows: current flows at an electrical contactor 240 through primary coil 79 and into the secondary coil 80', which provides current for energizing repulsion coil 80, thereby forming a powerful magnetic field at the interface betwen repulsion coil 80 and Eddy current plate 82. This action rapidly accelerates the Eddy current plate in a downward direction while mechanical energy is stored in the spring. The bit face 91 rests on a film of fluid on the bottom of the borehole so that the cutting face 84 of blade 83 travels distance 93 and repeatedly strikes the formation with great force, rather than fully compressing the return spring. Hence, a small amount of the energy from the repulsion coil is stored in the return spring while a great amount of the energy is consumed as the bit blade impacts against the formation.

Electrical current flows through the outer housing 64 of the drill collar, through the Multilams 240 of the bit motor, and to conductor 94, thereby providing the primary 79 with a current source. The current returns uphole from connection 95, through the inner housing 76, and through the annular contact 245 located at the pin ends 73 of the motor and bit combination 21.

Drilling fluid flows from axial passageway 74 of the motor, through the four bit passageways 90, and to the cavity 91 located on the lower face of the bit main housing or at the terminal end of the hydrostatic bit support 86. Drilling fluid passageway 92 is directed at the most optimum angle for cleaning and imparting rotational motion into the bit main body member 85. Numeral 93 indicates the space or operating range provided between the lower end 86 of movable blade 83 and the tungsten carbide cutters 84 of the fixed body. The lower end 97 of the motor main body 75 is in the form of a skirt and forms the lower open end of a counterbore within which the cylindrical bit shank is rotatably received.

In FIGS. 10 and 11, numeral 98 indicates the inner diameter of the rotatable bit main body 85. Numeral 99 indicates the upper angled surface of the cutter blade. The cutter blade is made integrally respective to the vibrating central part of the bit. Numeral 100 indicates another cutter blade arranged perpendicular respective to blade 83.

FIG. 11 illustrates the Eddy current plate 82 in the alternate position which is displaced from the repulsion hammer coil when a suitable current is effected on the pulse transformer. This action moves the tungsten carbide faces 84 located on the bottom of the cutters into engagement with the bottom of the borehole, and removes material therefrom. At the same time, drilling fluid flows through bit passageway 90 and the hydrostatic bit support 91, thereby causing the bit to "float" on the drilling fluid at the bottom of the borehole. The electrical current effected on the co-axial pulse transformer causes the tungsten carbide cutters 84 to hammer against the bottom of the borehole at a frequency determined by the surface generation equipment.

As the bit hammers against the borehole bottom, the impact of the asymmetrical bit blades induce a turning moment into the rotatable part of the bit, and the jets at 92 also induce a turning movement in to the hammer bit so that the bottom of the bit is slowly turned in a rotational manner about the longitudinal central axis of the borehole. Note the relative positions of the faces 84 and 86, respectively, of the blades and rotatable body, respectively.

The bit blade of FIGS. 10–13 is in the form of a Maltese Cross, and it is considered within the comprehension of this invention to provide a single or multiple blades to which the secondary blades are mounted. The formation contacting face of the bit is made asymmetrical with the wedge oriented to induce a turning force into the bit.

OPERATION

Figure 12:
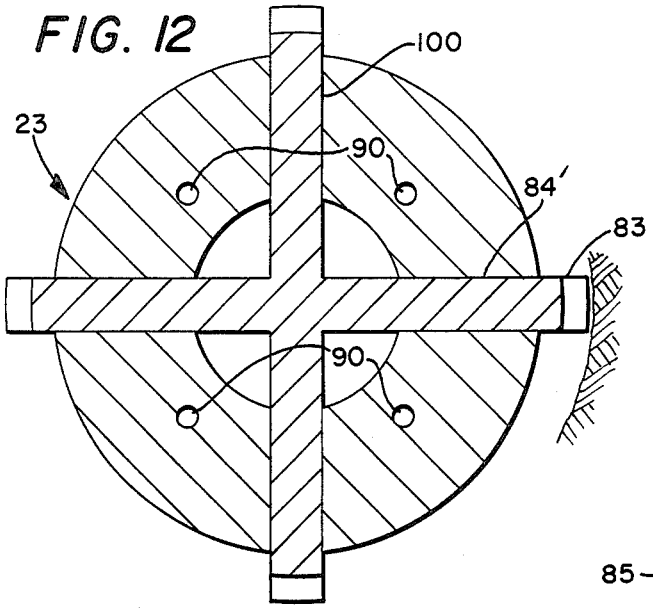
FIG. 12 is a cross-sectional view taken along line 12—12 of FIG. 11; and, FIG. 13 is a bottom view of the apparatus seen in FIG. 11, looking in the direction indicated by the arrows 13—13.
Figure 13:
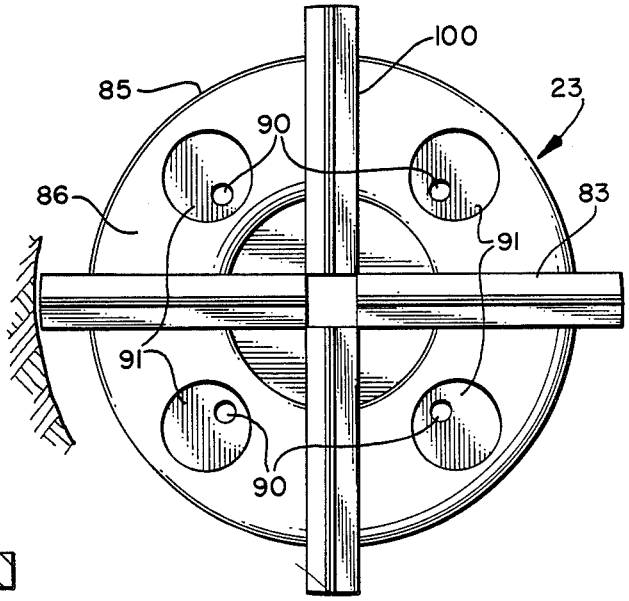
Figure 14:
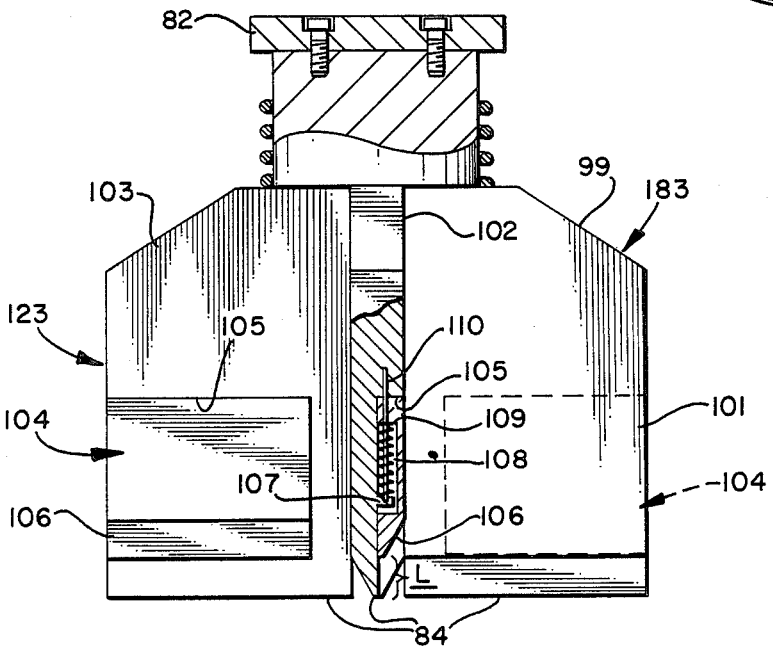

The overall combination of this invention is broadly set forth in FIG. 1. FIGS. 2–13 set forth the details of the various subcombinations of the invention. FIGS. 2–4 show the preferred embodiment of the novel drill pipe string; FIGS. 5–8 show the preferred embodiment of the drill collar assembly; and, FIGS. 11–13 show the preferred embodiment of the drill bit and pulse transformer.

In carrying out the present invention, the drawworks and rig of FIG. 1 can be of conventional construction, including the blowout preventor and mud circulation system. There may occasionally be a need for rotating the tool string, so it is advantageous to include a light duty rotary table at 28, and a conventional bowl together with adequate prior art slips that can be advantageously employed therewith. The traveling block 29 properly positions the bit face 84 and 91 of the bit 23 so that the optimum weight is in effect at 24 as hole 12 is being made.

It is essential that the cyclindrical surface area 45 and 40 of FIG. 2, for example, have a current carrying capacity provided at each of the threaded joints which enables the current to efficiently flow from one tool joint 16, 16' or 20 to the next adjacent tool joint. The current carrying capacity must therefore be achieved with a satisfactory $I_2R$ drop thereacross, so that the power generated at 27 is suitably transferred downhole to the bit motor 22 with an acceptable accumulated loss in efficiency at the multiplicity of connections during the drilling operation.

For this reason, the transfer of current is primarily achieved through or across the large surface area at the Multilams (40, 45, 49, 58, 140, 158, 240, 245) rather than through the threaded area, 38 and 39, thereby overcoming one major prior art problem in a novel manner. The construction of the annular conductors, 32 and 33, for example, and the unobvious manner in which the joints 16' can be made up into a novel pipe string is believed to provide unexpected, desirable results in the art of deep boreholes that has not heretofore occurred to those skilled in the art.

The hard metal employed at 47 can be a metal sleeve, as pointed out above, or a metal spray using known techniques. The metal 47 protects the relative soft underlying aluminum while making up and breaking out the tool joints. Otherwise, great care must be exercised in handling the joints, and special slips and power tongs must be employed to avoid structural damage to the marginal ends of the tool joints.

The confronting shoulders seen at 44, 46, 55, 57 in FIG. 4 provide a seal when properly torqued together. Where deemed desirable, additional seal means suggested by the prior art can be employed at or near these shoulder areas to increase the seal action thereof.

The drill pipe joints disclosed herein can be used for turning a rotary bit, for supporting a hammer bit, or a combination thereof.

In the drill collar illustrated in FIGS. 5–8, it is necessary to effect a pressure differential between selected opposed longitudinal cavities 67, that is, provide cavity 67N with a relatively high pressure while cavity 67S is provided with a relatively low pressure, or vice versa, for example, to thereby bow the collar into a direction which causes the bit to penetrate in a direction which returns the hole to vertical, as previously discussed in conjunction with the schematical illustration of FIG. 7. The prior art that can be advantageously employed for the details of design is found in U.S. Pat. Nos. 3,637,032 Jeter; 3,903,974 Cullen; and 3,043,381 McNeely, Jr.

There are many examples of inclinometers in the prior art, such as Jeter 3,637,032, for example. An electrical signal can be generated by an inclinometer and run up the conducting string to the surface where it is appropriately analyzed, and a second signal run back downhole using the conducting drill string, and to the collar, where the appropriate valve for the bowing chamber is opened for bowing or curving the collar in the desired direction.

The bit and motor used in conjunction with the present invention preferably is in the form suggested in FIGS. 10–13. The bit motor preferably is a pulse transformer which receives high voltage alternating current from a pulsed power supply, by means of the coaxial electrically conductive lightweight drill pipe. The hammer drill bit 85 has a main housing, and an axial passageway extends through the main housing. A plurality of bit blades are affixed to a central mount and the blades extend radially therefrom. The central mount is reciprocatingly and rotatably received within an axial bore formed within the main housing. A high conductivity Eddy current plate is affixed to the upper end of the central mount and is vibrated by the repulsion coil tied electrically to the secondary coil of the pulse transformer. The weight of the bit and frequency of vibration, along with the design characteristics of the pulsed transformer, are selected to provide the optimum impact of the bit face against the borehole bottom. It may be possible to achieve a resonant frequency of the moving parts of the bit respective to the fixed parts and to the formation.

The bit main body has downwardly extending members separated from one another by the blades to form circumferentially spaced legs. The lower face of the leg members are provided with a pocket. Drilling fluid flows through the motor, through the legs, and into the pockets, thereby giving the bit a floating action, that is, a fluid cushion is formed below the face of the leg members, while the blades impact against the formation. The fluid jets at 92 clean the bit and may place a small rotational force on the bit.

It is possible to use other insulation material for insulating the interior and exterior walls of the pipe string and collar from the well fluids. A ceramic, such $Al_2O_3$, can be sprayed onto the metal surface, thereby providing ceramic insulation which avoids the occurrance of a chemical reaction between the drill string and the mud.

It may be deemed desirable to weaken the outer conducting member 20 of the collar 19 by placing a multiplicity of spaced grooves in the outer surface thereof all along the length thereof, thereby reducing the stiffness of the collar and rendering the collar more flexible so that the bowing action is accentuated.

I claim:

1. Apparatus for forming a borehole comprising a drill string having an electric motor means and a drill bit connected at the lower end thereof, an axial passageway formed through said string and motor means through which drilling fluid can flow to a lower face of said bit; means connecting said motor means to drive said bit;

said drill string includes inner and outer concentric electric conducting annular members, means by which said inner and outer annular members are electrically insulated from one another and form separate annular current flow paths from an upper end of the string to the motor means;

said drill string is made up of a multiplicity of series connected drill pipe joints, each of said joints having an upper male fluid and electrical conducting member and a lower female fluid and electrical conducting member; the male and female members each having spaced annular conducting areas made complementary respective to one another to thereby provide said separtate annular current flow paths between adjacent joints;

whereby a source of electrical current can be connected at the upper end of the string and thereby provide the motor means with power.

2. The apparatus of claim 1 and further including a directional drill collar means connected in said string for deviating a hole, said collar means having an annular body, an axial flow passageway formed therethrough, said body includes concentric electrical conductors spaced from one another in fixed relationship by insulation means so that current can flow from said separate annular current flow paths through said conductors, and to the motor means for driving said bit;

means forming spaced elongated passageways through within said body, said passageways are located between said concentric electrical conductors and are parallel to the longitudinal axis of the string;

and means for effecting fluid pressure within a selected one of said passageways to cause the collar to be bent into a curve.

3. The drill string of claim 1 wherein said electric motor means is a pulse transformer having induction coils arranged to reciprocate an eddy current plate; means mounting said bit respective to said motor means to cause at least part of said bit to vibrate in response to movement of said eddy current plate.

4. The drill string of claim 1 wherein said bit is provided with a main body, means attaching said main body to said motor, a plurality of bit blades, means mounting said bit blades for reciprocation respective to said main body, and means connected to cause said motor means to vibrate said bit blades.

5. The drill string of claim 4 wherein said bit main body has an upper cylindrical marginal end; said motor has a main body which has a lower marginal end in the form of a skirt member, means by which said upper cylindrical marginal end of said bit is received for rotating within said skirt member; said blades are fixed to and radiate from a central member, said central member is reciprocatingly received within the lower end of said bit main body.

6. The apparatus of claim 1 wherein said bit has an upper body by which said bit can be attached in supported relationship respective to said drill string; a lower body, means rotatably attaching said lower body to said upper body;

said lower body has a cylindrical upper marginal end and vertical slots formed in the lower marginal end thereof; blades reciprocatingly received in the slots, an axial support member; and blades being attached to the lower end of said axial support member, means by which the upper end of said axial support member is captured respective to said lower body in a manner to reciprocated vertically respective thereto, and means attached to the upper end of said axial support member for imparting vibratory motion into said blades.

7. The apparatus of claim 1 wherein said motor means has a main annular housing, attachment means located on the lower end of said housing by which said drill bit can be supported therefrom; attachment means located on the upper end of said housing by which said motor means can be connected at the lower end of said drill string;

means forming a pulse transformer having an annular primary and secondary electrical winding within said housing, means forming a fluid flow passageway through said housing and through said primary and secondary electrical winding; electrical conductor means by which a source of current can be connected to said primary winding; means arranging said primary and secondary windings within said housing whereby current flow through the primary induces current flow through the secondary winding;

a repulsion coil means associated with said secondary winding; a high conductive eddy current plate oriented in a manner to induce vibratory motion into said bit.

8. The apparatus of claim 7 wherein said housing has a cylindrical skirt member circumferentially extending about the upper end of the bit, and means by which said bit is rotatably captured within said skirt.

9. The apparatus of claim 7 wherein said flow passageway extends axially through said primary and secondary coils, and then radially outward through a plurality of individual passageways, and then vertically in spaced relationship respective to one another to provide fluid flow to the lower end of the bit.

10. The apparatus of claim 7 and wherein said bit has a body rotatably affixed to the motor housing, a plurality of slots formed through the lower marginal end of the bit body which divides the lowermost end of said bit body into a plurality of hydrostatic bit supports;

bit blades reciprocatingly received within the slots of the bit body, said blades are connected to be moved by said eddy current plate, and means by which a passageway is formed from said axial passageway to each hydrostatic bit support.

11. The apparatus of claim 10 wherein said passageway through the bit support includes an outlet port oriented to impart a turning force into the lower end of the bit, and the lower edge of the blades are asymmetrical and engage the bottom of the borehole in a manner to impart a turning force into the end of the bit.

12. The apparatus of claim 10 wherein the bit includes an axial member received within the main annular housing; journal means for low friction rotation of the bit body respective to the motor means; and means by which the bit body is rotatably fastened to the motor means.

13. In a borehole forming tool string of the type having an electric powered motor means at the lower end thereof by which a drill bit is actuated, and a drill pipe string having the lower end connected to support the motor means and the upper end connected to be supported by a derrick, the improvement comprising:

said pipe string comprises a plurality of pipe joints, each pipe joint has a connection at each opposed end thereof by which a plurality of joints can be connected into a pipe string;

each pipe joint comprises inner and outer annular electrical conductive members having insulation therebetween which electrically insulates the inner member from the outer member; and a fluid passageway formed axially through the pipe joint; said connection includes a threaded marginal end formed on the opposed ends of the inner and outer conductive members;

contact means at each connection at each opposed end of a pipe joint for electrically connecting adjacent outer members of adjacent pipe joints to one another and electrically connecting adjacent inner members of adjacent pipe joints to one another;

whereby a source of electrical current can be connected at the upper end of the string and thereby provide the motor means with power.

14. The apparatus of claim 13 and further including a drill collar for connection into the tool string and used downhole in a borehole for controlling hole deviation; said collar has an axial passageway through which drilling fluid can flow;

a plurality of longitudinal bowing chambers circumferentially extending about said axial passageway for bowing said collar in a selected direction away from the central axis thereof; said chambers are radially spaced from said axial passageway; means for effecting pressure differential between opposed said bowing passageways;

said collar includes an inner annular conductive member insulated from an outer annular conductive member for conducting current from a location above the collar to a location below the collar; means by which said inner annular conductive member is fixed in concentric relationship respective to the outer annular conductive member;

connection means at opposed ends of the collar by which said collar can be connected into said drill string; said connection means at opposed ends of said collar effects current flow through the collar.

15. The apparatus of claim 14 wherein said bowing chambers are formed within said insulation means at a location between said inner and outer conductive members;

said upper end of said collar is in the form of a threaded pin end and said lower end is in the form of a threaded box end, and electrical contacts are formed at said pin and box ends for conducting current along a drill string.

16. The improvement of claim 13 wherein said connection at one end of a joint is a male configuration and the connection at the other end of a joint is a female configuration;

said male configuration having axially spaced threads made complementary respective to spaced threads formed on the female configuration of the pipe joint; an annular electrical contact area formed on said male end at a location adjacent the threaded surface of said outer conductive member, and adapted to be received within a complementary annular contact area formed within said female end at a location adjacent the threaded surface of said outer conductive member;

a second annular electrical contact area formed on said male end at a location adjacent the threaded surface of said inner conductive member, and adapted to be received within a complementary annular contact area formed within said female end.

17. A fluid and electrical conductive pipe joint that can be connected into a pipe string by which drilling fluid can flow along a longitudinal axial flow path formed therein downhole to a drill bit, while an electrical current flow path can be established through the pipe string down to an electrical drill bit motor, and back up the string to the surface of the earth;

said pipe joint comprises an inner and an outer annular member concentrically arranged about a common axis and spaced radially to form an annular area therebetween, means by which the inner and outer members are electrically isolated from one another by insulation means located in the annulus formed therebetween;

fastener means formed at opposed ends of said pipe joint by which a plurality of pipe joints can be electrically and flow connected in series relationship to form a pipe string through which fluid and electricity can be conveyed;

said fastener means includes threaded opposed marginal ends of the inner and outer annular members;

whereby a source of electrical current can be connected at the upper end of the string and thereby provide a bit motor with power.

18. The pipe joint of claim 17 wherein said fastener means at the upper end of the pipe joint is a male threaded area formed on the inner and outer annular members, the threaded inner annular member extending upwardly above said outer annular member; electrical surface contact area formed on the upper marginal end of the inner annular member and an electrical contact area formed on a medial length of the outer annular member;

said fastener means at the other end of the pipe joint is a female threaded area made complementary respective to the male threaded area.

19. The apparatus of claim 17 wherein a bit having a main body is included; the lower marginal end of said housing is in the form of a cylindrical skirt member within which the upper marginal end of the bit main body is received;

a plurality of slots formed through the lower marginal end of the bit body which divides the lowermost end of said bit body into a plurality of hydrostatic bit supports;

bit blades reciprocatingly received within the slots of the bit body, said blades are connected to be moved by said eddy current plate, and means by which a passageway is formed from said axial passageway to each hydrostatic bit support.

* * * * *

UNITED STATES PATENT AND TRADEMARK OFFICE

CERTIFICATE OF CORRECTION

PATENT NO. : 4,722,402

DATED : FEBRUARY 2, 1988

INVENTOR(S) : JAMES M. WELDON

It is certified that error appears in the above-identified patent and that said Letters Patent is hereby corrected as shown below:

Column 1, line 54, correct the spelling of "maintain";

Column 6, Line 43, substitute --a-- for "A";

Line 44, substitute --(TM)-- for "TM";

Column 8, line 46, delete "same";

Column 9, line 53, correct the spelling of "collar";

Column 12, line 44, insert --easily-- after "can";

Column 14, line 29, delete --through-- before "within";

Column 15, line 1, substitute --reciprocate-- for "reciprocated",

Line 37, delete "and" after Claim 7.

Signed and Sealed this

Thirtieth Day of June, 1992

*Attest:*

DOUGLAS B. COMER

*Attesting Officer*

*Acting Commissioner of Patents and Trademarks*